US005189860A

United States Patent [19]

Scott

[11] Patent Number: 5,189,860

[45] Date of Patent: * Mar. 2, 1993

[54] CONSTRUCTION SYSTEMS AND ELEMENTS THEREOF

[76] Inventor: Christopher R. Scott, 6518 Avenida Wilfredo, La Jolla, Calif. 92037

[ * ] Notice: The portion of the term of this patent subsequent to Jun. 11, 2008 has been disclaimed.

[21] Appl. No.: 643,281

[22] Filed: Jan. 22, 1991

Related U.S. Application Data

[60] Continuation-in-part of Ser. No. 458,779, Dec. 22, 1989, which is a continuation-in-part of Ser. No. 333,705, Apr. 3, 1989, which is a division of Ser. No. 16,364, Feb. 19, 1987, Pat. No. 4,817,356, which is a division of Ser. No. 578,285, Feb. 8, 1984, abandoned.

[51] Int. Cl.[5] ..... E04C 3/30

[52] U.S. Cl. ..... 52/729; 52/566; 52/690; 52/586

[58] Field of Search ..... 52/690, 729, 566, 648, 52/586, 404, 285, 286, 270, 271

[56] References Cited

U.S. PATENT DOCUMENTS

| | | | |
|---|---|---|---|
| 10,905 | 6/1893 | Barnes | 52/690 |
| 817,478 | 4/1906 | Fisher | 52/566 |
| 4,817,356 | 4/1989 | Scott | 52/690 |
| 5,022,210 | 6/1991 | Scott | 52/729 |
| 5,022,211 | 6/1991 | Scott | 52/690 |

FOREIGN PATENT DOCUMENTS

| | | | |
|---|---|---|---|
| 949859 | 10/1949 | France | 52/566 |
| 264217 | 10/1947 | Switzerland | 52/566 |
| 244632 | 12/1925 | United Kingdom | 52/566 |

*Primary Examiner*—David A. Scherbel
*Assistant Examiner*—Wynn E. Wood
*Attorney, Agent, or Firm*—Nydegger & Associates

[57] ABSTRACT

Construction elements of predetermined cross-sectional and end profiles are formed. These construction elements are useful in building construction. Included in an I-shaped element, a corner/connecting block and a D-shaped profile material. In addition, end cuts may be provided to provide interlocking assembly of the different elements, to establish a family of parts. The element can be pre-cut to desired lengths and assembled as kits, or as raw material, for use in all aspects of construction. Further included is a substantially C-shaped element which provides structural strength as well as distinctively different aesthetic aspects of construction.

8 Claims, 5 Drawing Sheets

Fig. 1
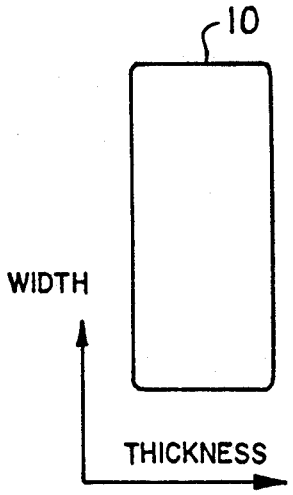
Fig. 2
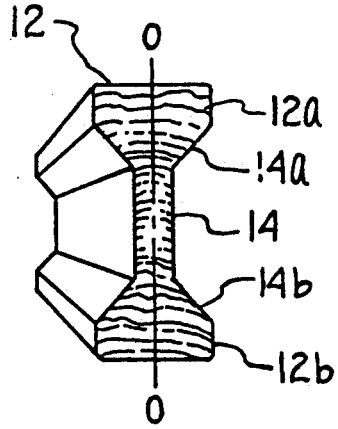
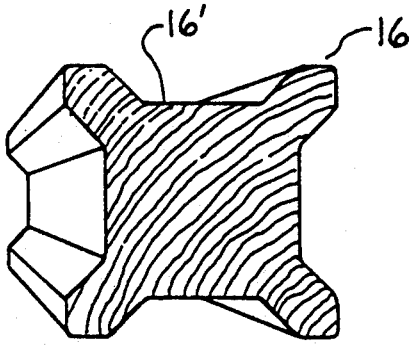
Fig. 4
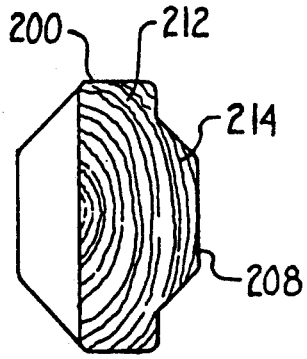
Fig. 3
Fig. 5
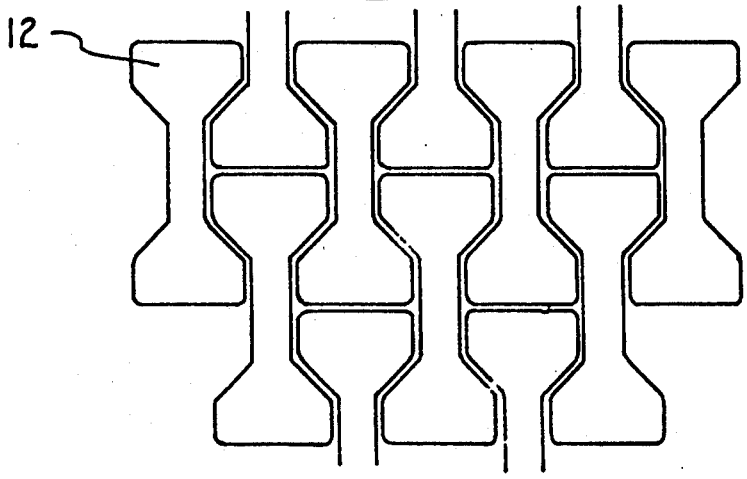

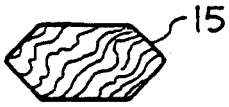
Fig. 7
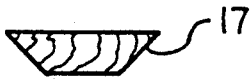
Fig. 8
Fig. 9A
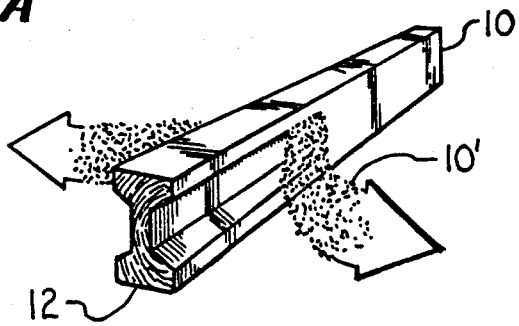
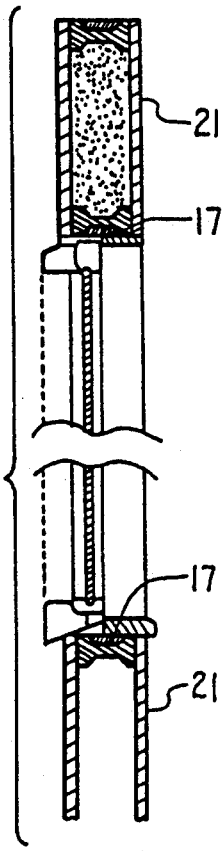
Fig. 10
Fig. 9B
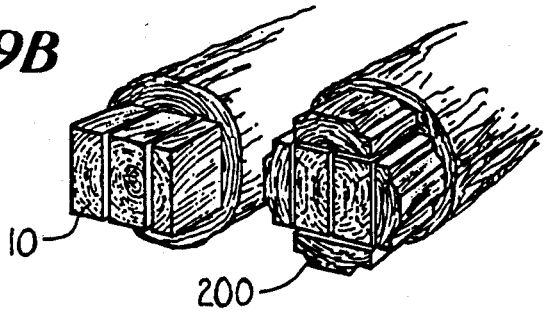
Fig. 11
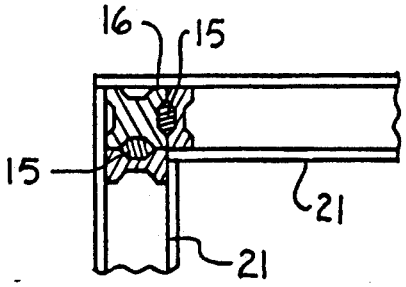
Fig. 12
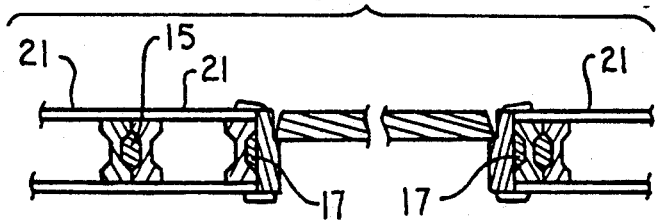

CONSTRUCTION SYSTEMS AND ELEMENTS THEREOF

FIELD OF THE INVENTION

This is a continuation in part of co-pending application Ser. No. 458,779 filed Dec. 22, 1989, which is a continuation in part of co-pending application Ser. No. 333,705, filed Apr. 3, 1989, which is a divisional of application Ser. No. 016,364 filed Feb. 19, 1987, now issued as U.S. Pat. No. 4,817,356, which is a divisional of application Ser. No. 578,285 filed Feb. 8, 1984, now abandoned.

This invention relates to building construction systems and the elements thereof. In one aspect, this invention relates to wooden profiled lumber for use in the construction and related industries.

BACKGROUND OF THE INVENTION

Wooden lumber that is commonly used by the building industry is of a rectangular cross section. For a large number of construction applications, however, the actual strength properties of lumber, as a building material, are far greater than what is structurally required. It would therefore be advantageous to provide lumber material which has the minimum cross-sectional dimensions necessary to satisfy the applicable strength requirements. This would not only reduce the cost of material, but also reduce the weight of the lumber and thereby lower the transportation cost. However, the size of the lumber material cannot be reduced below a minimum needed for providing a minimum surface area for joining together the various construction elements, or for satisfying other construction needs. For example, the thickness of lumber must be such as to allow adequate surface area for nailing the edges of two adjacent panels onto the edge of the lumber, or its width must be sufficient to provide adequate air or insulation in the spacing in a wall.

In addition, prior art building construction systems and elements require that the fasteners, i.e. nails, be able to withstand the full load being placed at the connecting points of a conventional frame structure. Ordinary rectangular studs can be twisted out of position due to structural stress. This can result in bent nails, separated joints, and structural weakness. Prior art building elements, because of the rectangular design, require more lumber and natural resources to manufacture. Also, the conventional rectangular cross section studs have significant weight and space requirements for shipping, handling and storing. In addition, the flat surfaces of the lumber allow high stacks to become unstable and become a potential safety hazard.

Prior art wooden lumber also has the disadvantage of warping and twisting as the lumber dries out. In addition, such conventional wood tends to split. Another disadvantage of conventional prior art building construction systems and elements is that the elements must be properly cut and fit together by highly skilled craftsman at the construction site to maintain accurate lines in construction, e.g. accurate right angles and proper horizontal and vertical placement. Significant amounts of experienced labor at the construction site is required. The fastening system is also relatively arcane in that brute force is required, and there are safety considerations in hammering nails or using staple guns.

Accordingly, it is an object of the present invention to provide a construction system and elements which comprise a family of parts which can fit together to provide more structural strength with less material. It is another object of the present invention to provide a construction system and elements which have less storage space requirements, and are conducive to more consistent building accuracy. It is yet another object to provide a construction system and elements which can be pre-cut to accurate dimensions, and then assembled in a relatively simple and convenient manner at the construction site.

SUMMARY OF THE INVENTION

In one embodiment, the present invention provides wooden construction elements having predetermined lengths and having cross-sectional profiles comprising a first flange portion having a predetermined thickness and width, a second flange portion having a predetermined thickness and width, the first and second flange portions being parallel to one another relative to their thickness dimension and interconnected by a central integral web portion of predetermined width and essentially smaller thickness than the flange portions.

In another embodiment, the present invention provides construction elements having predetermined lengths and having cross-sectional profiles comprising a first flange portion and a second flange portion, the first and second flange portions being of essentially identical predetermined thickness and essentially identical predetermined width. The first and second flange portions are parallel to one another relative to their thickness dimension and interconnected by a central integral web portion of predetermined width and of a thickness about one third of that of the flange portions, the width of the web portion being about equal to the sum of the widths of the flange portions.

In another embodiment, the present invention provides a construction element having a predetermined length and having a cross-sectional profile comprising a first flange portion and a second flange portion, the first and second flange portions being of essentially identical predetermined thickness and essentially identical predetermined width. The first and second flange portions are parallel to one another relative to their thickness dimension and interconnected by a central integral web portion. The central integral web portion comprises a uniform thickness section having a predetermined width and thickness about one third of that of the flange portions, a first transition section having a width about equal to that of the first flange portion and connecting the first flange portion and the uniform thickness section and having a thickness tapering from that of the first flange portion to that of the uniform thickness section, and a second transition section having a width about equal to that of the second flange portion and connecting the second flange portion and the uniform thickness section and having a thickness tapering from that of the second flange portion to that of the uniform thickness section. The predetermined width of the uniform thickness section is about equal to three times the width of one of the flange portions.

In another embodiment, the invention provides a panel building system comprising a plurality of sized panel structures, each panel structure comprising an open frame of predetermined geometric shape of a plurality of longitudinal members having a cross section comprising two parallel flange portions interconnected by an integral web portion. A thin, relatively rigid sheet of covering material closes at least one face of the open frame and cooperates with the frame to form a dimensionally stable panel structure. The panel building system further comprises a plurality of key block members having a cross section corresponding to the open cross section formed between two parallel longitudinal members which abut one another through their two flange portions, the key block members and the panel structures cooperating to link adjacent panel structures along the longitudinal edges thereof; a plurality of filler blocks having a cross section corresponding to the open cross section formed between the two flange portions and the web portion on one side of a longitudinal member, the filler blocks and the panel structures cooperating to form flat faces along the longitudinal edges of the panel structures; and a plurality of corner/connecting blocks having a symmetrical generally square cross section wherein each face of the square has a longitudinal groove corresponding to the open cross section formed between the two flange portions and the web portion on one side of the longitudinal members, and thereby forming two longitudinal abutment surfaces, separated by the groove, corresponding to the flange portions of the longitudinal members, the corner/connecting blocks, the key block members and the panel structures cooperating to link two or more panel structures along respective longitudinal edges at right angles to one another.

In another embodiment, the invention provides a building system for the construction of structures, comprising a plurality of longitudinal members having a cross section comprising two parallel flange portions interconnected by an integral web portion; and a plurality of transverse members of predetermined length having end portions receivably engageable by the cross-sectional shape of the longitudinal members, the longitudinal members and the transverse members cooperatively engageable to form a structure of parallel spaced apart longitudinal members.

In a further embodiment, the present invention provides a corner/connecting block having a predetermined length and having a cross-sectional profile comprising a symmetrical generally square cross section, each face of said square having a longitudinal groove formed therein, said groove being of symmetrical trapezoidal shape wherein the non-parallel faces of said symmetrical trapezoid open outwardly from the central portion of said square.

In yet another embodiment, the present invention includes a construction element which has a substantially C-shaped cross-sectional profile. The C-shaped construction element has a pair of parallelepiped-shaped end portions that have rectangular cross sections and a parallelepiped-shaped central web portion that also has a rectangular cross section. Each end portion is connected to the central web portion by a respective parallelepiped-shaped transition portion that has a non-rectangular (i.e., parallelogram-shaped) cross section. Each transition portion forms an angle of about 45° with the central web portion. Also, each transition portion forms an angle of about 135° with its respective end portion. The C-shaped construction element is of a dimensional profile such that it cooperates in a construction system with the I-shaped and D-shaped construction elements disclosed above.

The novel features of this invention, as well as the invention itself, both as to its structure and its operation, will be best understood from the accompanying drawings, taken in conjunction with the accompanying description, in which similar reference characters refer to similar parts, and in which:

BRIEF DESCRIPTION OF THE DRAWINGS

FIG. 1 illustrates the cross-sectional shape of conventional wooden lumber;

FIG. 2 illustrates a cross-sectional perspective view of an I-shaped construction element in accordance with the present invention;

FIG. 3 illustrates a cross-sectional perspective view of a D-shaped construction element in accordance with the present invention;

FIG. 4 illustrates a cross-sectional perspective view of a block element in accordance with the present invention;

FIG. 5 shows interlocking of construction elements, in accordance with the present invention;

FIG. 7 is a cross-sectional profile of a key block member in accordance with the present invention;

FIG. 8 is a cross-sectional profile of an embodiment of a filler block in accordance with the present invention;

FIGS. 9A and 9B illustrate forming the I-shaped construction element for conventional wooden lumber, and from raw material;

FIG. 10 is a sectional view of an embodiment of a window jamb assembly in accordance with the present invention;

FIG. 11 is a sectional view of an embodiment of a corner assembly in accordance with the present invention;

FIG. 12 is a sectional view of an embodiment of a door jamb assembly in accordance with the present invention;

DETAILED DESCRIPTION OF THE PREFERRED EMBODIMENTS

Figure 6:
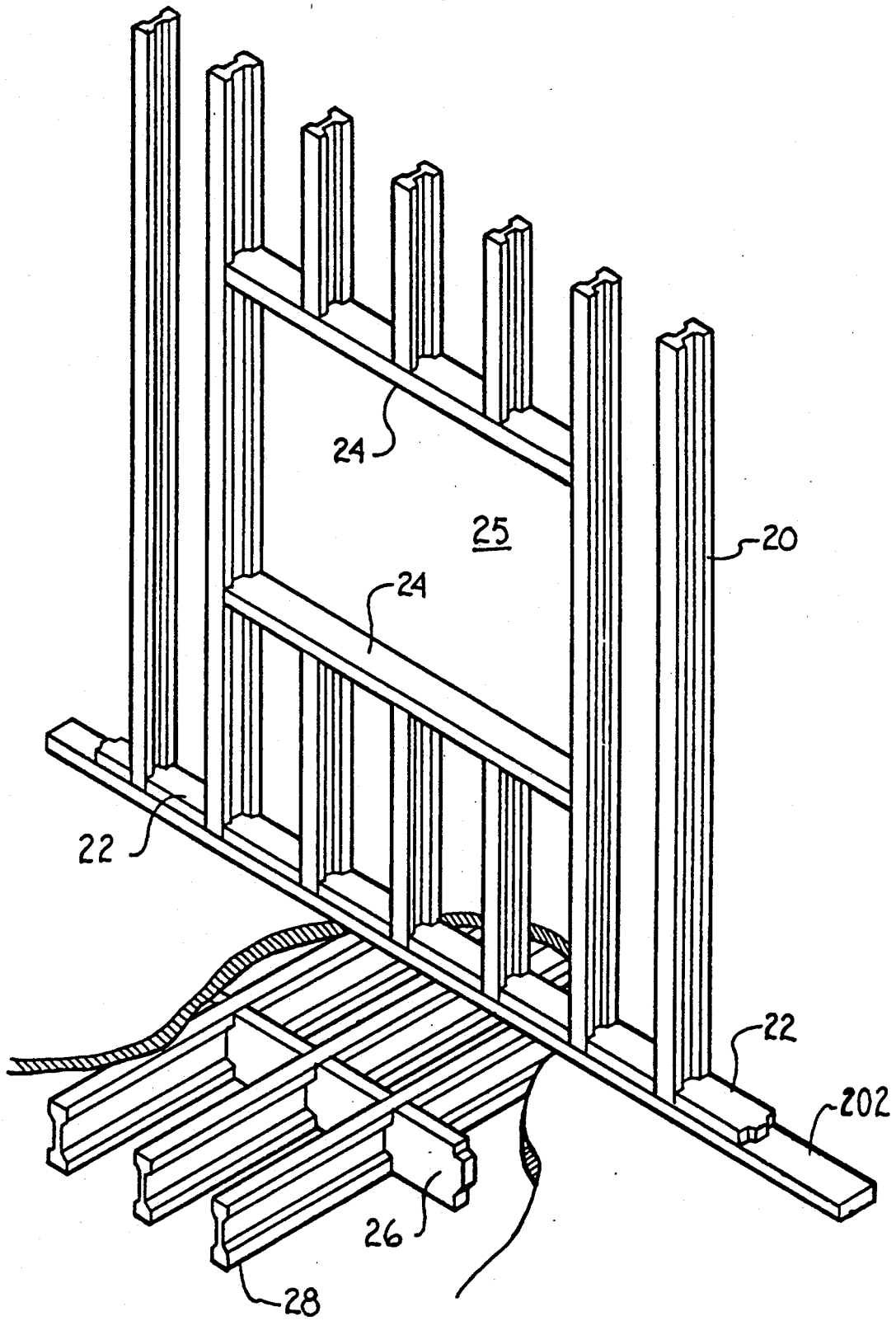
FIG. 6 illustrates a simplified use of the construction elements in accordance with the present invention in a building concept based on the utilization of pre-cut transverse members having end portions which are affixed in the grooves of the construction elements between adjacent elements.

Referring to FIG. 1, there is shown a cross section of a conventional 2"×4" wooden lumber or stud 10 as commonly used in the building industry, particularly for constructing residential dwellings. FIG. 2 shows a perspective cross-sectional view of a wooden construction element 12 which may be manufactured by making trapezoidal grooves in the walls of the conventional stud of FIG. 1 The dimensions given in FIG. 1 are the approximate dimensions of a conventional 2"×4" wooden lumber or stud and the dimensions given in FIG. 2 are the approximate dimensions of the grooves made in the walls of the conventional wooden lumber or stud to make the construction element according to the present invention. The thickness and width dimensions are shown by the scale in the lower left-hand corner of FIG. 1.

The wooden construction elements have a cross-sectional profile comprising a first flange portion 12A having a predetermined thickness and width, a second flange portion 12B having a predetermined thickness and width. The first and second flange portions are parallel to one another relative to their thickness dimension and interconnected by a central integral web portion 14 of predetermined width and essentially smaller thickness than the flange portions.

The shaping of the wooden construction element is preferably performed by forming a groove in each wall of a conventional wooden lumber or stud, thereby removing a total of between about 15% and 50% of the material 10' of the original cross section as shown in FIG. 9A. The actual width of the groove is preferably such that the material removed is about equal to the sum of the width of the material left in the two flange portions 12A and 12B. The actual thickness of the web portion 14 of the wooden construction element would depend on the use of the product, but is preferably not less than one third of the thickness of the flange portion 12A or 12B. These proportions also offer an ideal shape for nesting as will be explained hereinafter.

The web material can be removed by routing, splitting or with conventional chip and saw type machinery, preferably by using a chipping machine having suitably shaped chipper heads. The material so-removed may advantageously be used to make chips for the pulping industry, providing material for composite wood products such as particle or wafer board, for making molding material, or used as an energy source when burnt as fuel. The savings in the number of trees required for lumber is also quite beneficial, as illustrated in FIG. 9B.

As mentioned earlier, FIG. 2 shows the I-shaped cross section produced by making a trapezoidal groove in the wall portions of a conventional wooden lumber or stud. In this embodiment, the central web portion comprises a uniform thickness section 14 having a thickness less than that of the flange portions 12A or 12B, a first transition section 14A, connecting the first flange portion 12A and the uniform thickness section 14, having a thickness tapering from that of the first flange portion to that of the uniform thickness section, and a second transition section 14B, connecting the second flange portion 12B and the uniform thickness section 14, having a thickness tapering from that of the second flange portion to that of the uniform thickness section. This configuration reduces the possibility of splitting the edges of the wooden construction element when nailing panels to the edges of the construction element.

FIG. 2 thus shows the preferred shape and dimensions to provide the best compromise between strength and weight for a wooden construction element, which is aesthetically pleasing and suited for shipping and as a building element.

As previously noted, the width of the groove forming the web portion 14 of the wooden construction elements of FIG. 2 is preferably about equal to the width of the material left in the two flange portions 12A and 12B. This leaves sufficient material for adequate nailing or otherwise securing panels or other structural elements to the edges of the construction elements. This particular shape is also designed to allow interlocking of the construction elements for shipping in such a way that they nest together like a jigsaw puzzle to optimize volume savings, as shown in FIG. 5. This shape also avoids the necessity for the use of "stickers" (to prevent lumber slippage over itself) when shipping the lumber. With respect to the preferred "I" shape of FIG. 2, the oblique surfaces 14A and 14B allow easier nailing for maximum strength, i.e. a nail perpendicular to this surface can be driven through the wood at an angle to center line 0—0, whereas a conventional 2"×4" would required that the nail be held at an angle to the wood surface (it being much easier to drive a nail perpendicular to the surface than at an angle to the surface). This also reduces splits at the edge of the stud, and allows the fastener to make a more solid connection of the wood being fastened together.

The actual thickness of the web portion 14 of the construction elements depends on the strength properties required for the end use of the product. For a large number of applications, such thickness would be about a third of the original thickness of the original lumber or stud, i.e. the thickness of the flange portions 12A or 12B, such as shown in FIGS. 2 and 3 of the drawings.

It has been found that the above shaping of conventional wooden lumber or studs into construction elements reduces the lumber strength properties, but as previously mentioned, the strength properties of lumber are far greater than structurally required in many applications, and the cross-sectional area of the lumber can be easily reduced by a substantial amount for these applications. This excess wood material removed to form the construction element provides additional usable material from a given volume of wood. There is a shortage in North America of wood chips suitable for use in pulp and paper mills. Thus, the construction elements of this invention may yield a considerable volume of pulp wood chips without a commensurate reduction in the quality of lumber available for use in the building construction industry.

Other advantages of the wooden construction elements in accordance with the invention are:

(a) easier building with these elements since there is less skill required in nailing, and there is less material to cut, and in some cases no cutting is required since the material is pre-cut at the factory.

(b) I-shaped joint assembly, or tongue-in-groove type assembly results in greater structural strength;

(c) the "I" shape of the preferred wooden construction elements reduces the stress points in the wood when drying thereby reducing the splitting and cracking that takes place during the drying process;

(d) the grooves forming the web portion of the wooden construction elements permit improved flow of air in the kilns resulting in more rapid and efficient drying of wood;

(e) the grooves forming the web portion of the wooden construction element also provide extra surface area to simplify and improve the holding power of the fasteners used; and (f) stacking of construction elements for storage and shipping requires less space and stays together better.

Although the wooden construction elements have been disclosed with reference to the cross-sectional profiles illustrated in FIG. 2, it is to be understood that the shape of the grooves forming the web portion of the wooden construction elements may be varied according to the end use of these disclosed shapes are not limiting on the invention.

In this regard, it should be borne in mind that the first and second flange portions are preferably of identical shape and size. Additionally, while the wooden construction elements have been disclosed in the context of a 2"×4" configuration, the particular profiles are equally applicable to larger stock, e.g. 2"×6", 2"×8", 4"×4", etc. and smaller stock, e.g. 1"×1", 1"×2", etc.

The wooden construction elements can be supplied in standard lengths utilized in the building industry, e.g., 8', 10', 12', etc., but can also be formed in lesser or greater lengths as dictated by job requirements. Such elements may advantageously be made into a pre-cut family of parts so no cutting is required at the construction site.

With respect to the wooden construction elements, it should also be noted that while these have been disclosed as being prepared from sawn lumber, e.g. 2"×4" stock, the term "wooden" extends to wood products such as glued wooden pieces forming the appropriate cross-sectional profile, e.g. the flange portions 12A and 12B are glued to the ends of a web portion 14 to form the desired cross-sectional profile, etc. and oriented strand or wafer board (known in themselves in the art as a mixture of reconstituted wood fibers (cellulose fibers) and a glue matrix which may additionally contain wood chips, particles or strands) which have been extruded in the desired cross-sectional profile.

In another embodiment, the present invention provides construction elements made of, in addition to wood, materials of construction such as plastic, preferably structural plastics including foams; metal such as sheet metal or aluminum, preferably extruded aluminum; and composites such as graphite composites, carbon composites, or a plastic foam that is formed in the appropriate cross-sectional profile and contained in a sheet metal sheath of corresponding cross-sectional profile (the sheath being sealed by welding, soldering or gluing along a longitudinal seam or seams).

Preferably, these construction elements have a cross-sectional profile (as shown in FIG. 2) comprising a first flange portion 12A and a second flange portion 12B, the first and second flange portions are of essentially identical predetermined thickness and essentially identical predetermined width. The first and second flange portions are parallel to one another relative to their thickness dimension and interconnected by a central integral web portion comprising a uniform thickness section 14 having a predetermined width and a thickness about one third of that of the flange portions, 12A or 12B; a first transition section 14A having a width about equal to that of the first flange portion 12A and connecting the first flange portion 12A and the uniform thickness section 14 and having a thickness tapering from that of the first flange portion 12A to that of the uniform thickness section 14; and a second transition section 14B having a width about equal to that of the second flange portion 12B and connecting the second flange portion 12B and the uniform thickness section 14 and having a thickness tapering from that of the second flange portion 12B to that of the uniform thickness section 14. The predetermined width of the uniform thickness section 14 is about equal to three times the width of one of the flange portions, 12A or 12B.

These construction elements are suitably prepared in cross-sectional profile corresponding to an overall 2"×4" configuration, but are equally applicable to larger or smaller stock, e.g. 2"×6" or 2"×8", 4"×4", 1"×1", 1"×2", etc. These construction elements can be supplied in standard lengths utilized in the building industry, e.g. 8', 10', 12', etc., but can also be formed in lesser or greater lengths as dictated by job requirements.

These construction elements are suitably formed by bending, molding or casting, especially in the case of plastics, or by extrusion, especially in the case of metals, although the particular fabrication techniques can be used for any of the types of materials.

Additionally, the aforedescribed construction elements can be utilized in the building systems described hereinafter.

Additional structural members may be provided to allow ready interlock of the panel system and/or to facilitate conventional construction operations. These structural members can be formed in the same manner and of the same materials as the previously described construction elements.

FIG. 7 shows the cross-sectional profile of a key block member 15 which corresponds to the open cross section formed between two parallel longitudinal members 12 which abut one another through their flange portions **12*a* and 12*b*. Such key block members 15 cooperate with panel structures 21 to link adjacent panel structures along the longitudinal edges thereof, as shown in FIG. 12**.

FIG. 4 shows the cross-sectional profile of a post-/corner/connecting block 16 which is a symmetrical generally square cross section wherein each face of the square has a longitudinal groove 16' corresponding to the groove formed between two flange portions **14*a* and 14*b* and the web portion 14 (see FIG. 2) on one side of the aforedescribed longitudinal members 12. These grooves 16' form two longitudinal abutment surfaces, on each face of the square, corresponding to the flange portions 12*a* and 12*b* of the longitudinal members 20. The corner/connecting blocks 16, the key block members 15 and the panel structures 21 cooperate to link two or more panel structures along respective longitudinal edges at right angles to one another as shown in FIG. 11**.

Additionally, the corner/connecting blocks can be utilized in their own right as a post or a fence post due to their aesthetically pleasing appearance. For such uses, the corner/connecting block can be formed in a 6"×6" configuration or larger, in addition to the 4"×4" configuration, or a smaller 2"×2" configuration.

FIG. 8 shows the cross-sectional profile of a filler block 17 which corresponds to the open cross section formed between the two flange portions **12*a* and 12*b* and the web portion 14 on one side of a longitudinal member 12 (see FIG. 6). The filler blocks 17 and the panel structures cooperate for instance to form flat faces along the longitudinal edges of the panel structures 21, as shown in FIG. 10 for a window jamb assembly and in FIG. 12** for a door jamb assembly. Other embodiments of assemblies for windows and doors may also be used.

In another embodiment, the invention provides a building system for the construction of structures, and a house. As shown in FIG. 6, the system comprises a plurality of longitudinal members 20 comprising I-shaped members 12 having a cross section comprising two parallel flange portions interconnected by an integral web portion and a plurality of transverse members 22 of predetermined length having end portions receivably engageable by the cross-sectional shape of the longitudinal members 20, the longitudinal members 20 and the transverse members 22 cooperatively engageable to form a structure of parallel spaced apart longitudinal members. FIG. 6 shows a building section constructed using cut-to-length longitudinal member 20 of uniform cross-sectional shape, which shape is selected so that individual component parts may be interlocked together with a minimum of nailing and without requiring precise measurement or cutting at the job site as is the case with conventional building materials. This results in reduced on-site waste and very accurate framing. As shown in FIG. 6, a wall section may be constructed, in a 2"×4" format, with longitudinal member 20 held in spaced parallel relationship by pre-cut transverse members 22 having their ends shaped to fit into the grooves of the longitudinal members 20, thereby reducing nailing requirements to a minimum. The transverse members 22 are simply placed between adjacent longitudinal members 20 thereby fixing the distance between the studs precisely in accordance with building industry regulations. As also shown in FIG. 6, transverse members 24 of different standardized lengths may be provided to fix precisely the spacing of window openings 25 or door openings (not shown), according to building industry regulations. Similarly, pre-cut transverse members 26 may be provided for fixing the spacing of longitudinal members 28, in a 2"×10" format, as floor beams or joists. The system permits unskilled workers to assemble the framework for structures strongly and accurately without having to cut or measure material.

The above-described building system and elements is applicable to other frame construction industries including, but not limited to, mobile homes, recreational vehicles and industrial housing.

The longitudinal members in this building system, as well as in the previously described panel system, may have holes pre-cut therein, where appropriate, for fire sprinklers, plumbing and wiring applications.

The present building system may additionally include the aforementioned key block members, filler members and corner/connecting blocks to facilitate the construction of various structures conventional in the building trades.

Additionally, the aforedescribed building system and panel building system can be used in conjunction with one another thereby allowing customized building with standardized elements. Alternatively, the use of the systems in conjunction allows for construction of a structure at one stage and expansion or modification of the structure at a later stage, e.g. a "starter" home with provisions for expansion of the home as family size increases or economics allow.

Moreover, the use of standardized elements (panel structures, longitudinal members, transverse members, key block members, filler block members, corner/connecting blocks, etc.) allows the use of pre-set plans, tight control of materials of construction (minimum waste) and tight control (and prediction) of costs of construction.

In another embodiment of the present invention there is shown in FIG. 3 a perspective an end view of a D-shaped member or profile plate 200. Profile plate 200 is essentially a mirror image of the cross-sectional profile of longitudinal member 20. Profile plate 200 is used for example as a replacement for flat stud 202 shown in FIG. 6. Plate 200 has a base plate 212 and a trapezoidal flange portion 214 having a profile 208. Base plate 212 has a thickness approximately twice the height of flange 214.

Figure 13:
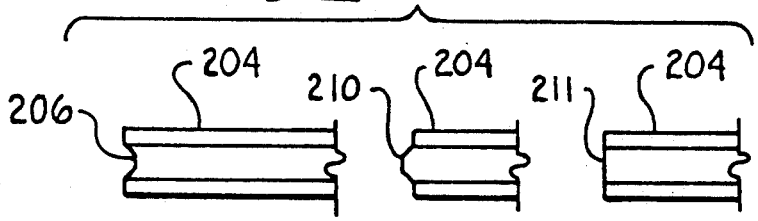
FIG. 13 is a top view of alternative embodiments of the longitudinal member.
Figure 14:
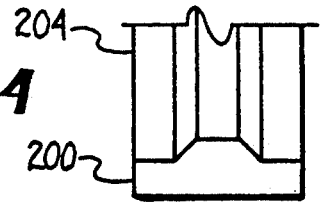
FIG. 14 is an end view of an embodiment of a joint assembly.
Figure 15:
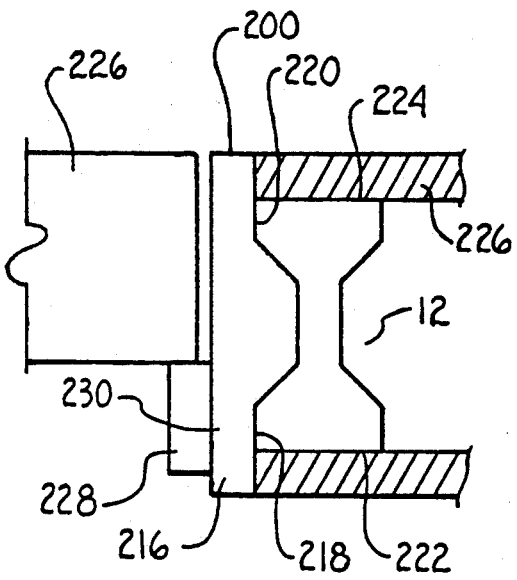
FIG. 15 is a top view of one embodiment of a construction of a door frame using elements according to the present invention.

Plate 200 may be used in conjunction with profile lumber stud 204 shown in FIGS. 13 and 14. Stud 204 is essentially identical to longitudinal member 20, except that it may have a female end cut portion 206. Female end cut portion 206 is a recess-shaped end which fits onto profile 208 of plate 200 as shown in FIG. 15. Alternatively, there may be a male end be appropriate, as shown by stud 12, or a straight end cut portion 211, either at 90°, 45° or other desired angle.

In another embodiment of the invention, plate 200 may be positioned on end as shown in FIG. 15, with additional extensions 216 which overlap edges 218, 220 of element 12. Flat surfaces 222, 224 then support drywall 226, which abuts against extensions 216. Door frame 228 can then be attached to flat edge 230 of plate 200, for handling door 226.

Figure 16:
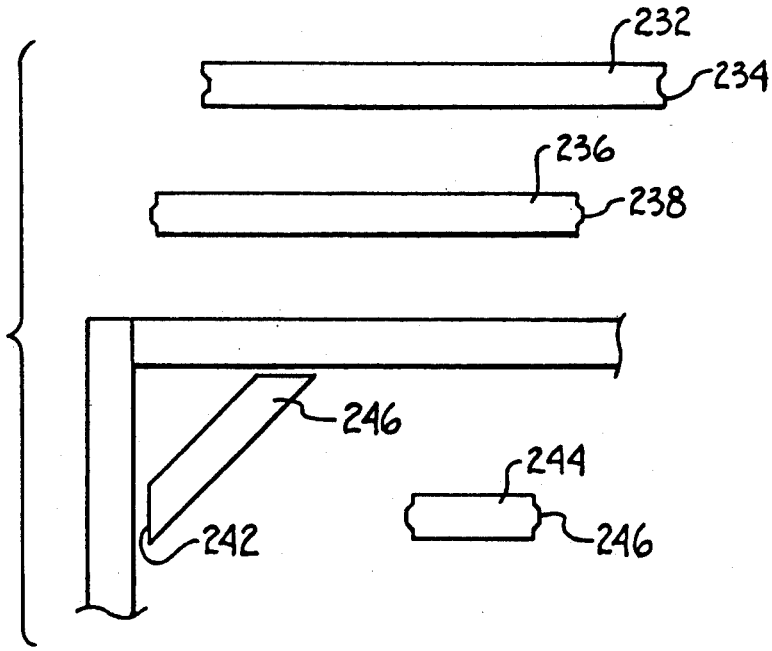
FIG. 16 is a top view of one embodiment of a group or family of parts for use in accordance with the present invention.

There is shown in FIG. 16 a sample of a family of parts having pre-cut lengths and end cuts of the elements to provide a convenient group of construction elements. Element 232 is a stud element 12 which is approximately 96" long with female end cuts 234. Sill element 236 is a window sill with male end cuts 238, and element 240 is a 45° I-shaped bracket with male cuts 242 at each end to fit into studs 14 and sill elements 276 as shown. Spacer block 244 having male end cuts 246 is also shown.

Figure 17:
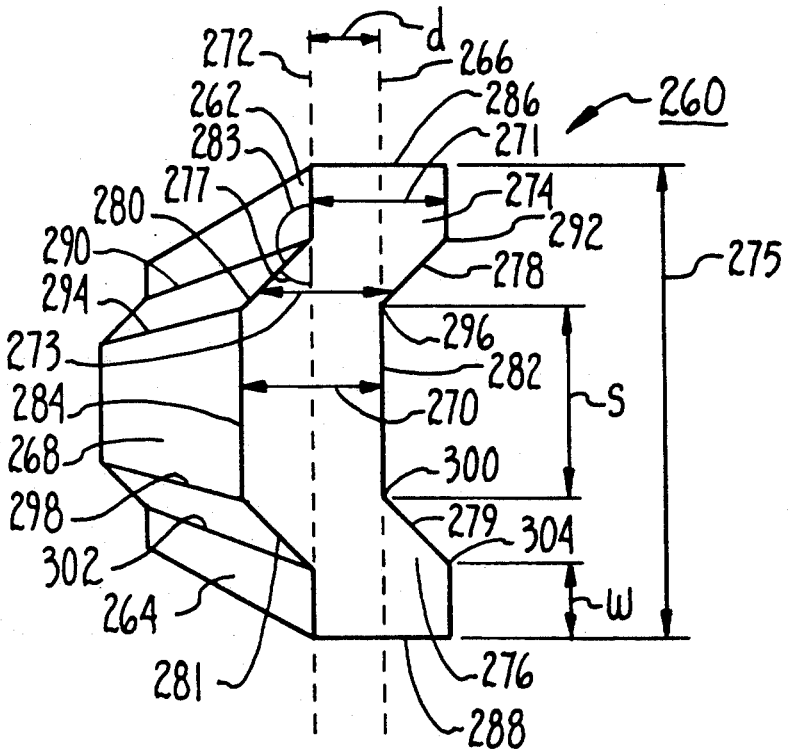
FIG. 17 is a perspective view of a C-shaped construction element in accordance with the present invention.

In FIG. 17, there is shown another construction element, generally designated 260, which has a substantially C-shaped cross-sectional profile. In particular, C-shaped element 260 has a first parallelepiped-shaped end portion 262 and second parallelepiped-shaped end portion 264. As shown, first and second end portions 262, 264 have substantially identical rectangular cross-sectional shapes, and are parallel to one another. First and second end portions 262, 264 are centered about an end portion midplane 266.

Element 260 also has a central parallelepiped-shaped web portion 268, which has a rectangular cross-sectional area defining a thickness 270. Thickness 270 of web portion 268 is approximately equal to thickness 271 of the end portion 262. A central midplane 272 bisects web portion 268. Midplane 272 is parallel to and offset by a predetermined distance "d" from midplane 266.

FIG. 17 also shows that a first parallelepiped-shaped transition portion 274 connects first end portion 262 to web portion 268, and a second parallelepiped-shaped transition portion 276 connects end portion 264 to web portion 268. First and second transition portions 274, 276 each have non-rectangular, parallelogram-shaped cross-sectional shapes. The cross-sectional shapes of portions 274, 276 each have a thickness 273 that is approximately equal to the thickness 270 of web portion 268. Also, transition portion 274 has parallel angled transition surfaces 278, 280, and portion 276 has parallel transition surfaces 279, 281. As shown in FIG. 17, surfaces 278, 279, 280, 281 form an angle 277 of about 45° with respect to midplane 272. Also, surfaces 278, 279, 280, 281 form an angle 283 of about 135° with resect to midplane 272. It is to be understood that portions 262, 264, 268, 274 and 276 can be integrally formed together. In other words, and portion 262 can have edges 290, 292 in common with transition portion 274, and portion 274 can have edges 294, 296 in Common with web portion 268. Likewise, portion 268 can have edges 298, 300 in common with transition portion 276, while portion 276 can have edges 302, 301 in common with end portion 264. Furthermore, end portions 262, 264, 268, 274, 276 can be as elongated as required for the particular application of element 260.

To facilitate storage of a plurality of elements 270, flat surface 282 of web portion 268 has a span "s" that is of a magnitude which is substantially equal to the combined widths "w" of first and second end portions 262, 264. Consequently, the end portions of additional C-shaped elements (not shown) can be interlocked or nested side-by-side onto flat surface portion 282 and angled transition surfaces 278, 279, similar to the nested arrangement shown for I-shaped members in FIG. 5.

First and second end portions 262, 264 further include first and second outer edge surfaces 286, 288, respectively. Outer edge surfaces 286, 288 are co-parallel surfaces which are spaced apart from one another by a distance 275. Distance 275 is about 3.5 to 4 times thickness 270 of web portion 268, and preferably about 3.7 times thickness 270. Also, the distance "d" by which end portions 262, 264 are offset from web portion 268 is preferably about one-half of thickness 270.

C-shaped element 260 can advantageously be used in building construction systems according to the present invention in locations in which distinctive decorative and aesthetic aspects are desired, in addition to the functional aspects. For example, the C-shaped element 260 can be used for railings, laminated beam construction, decorative batting, window sills and other related uses, to name a few. Functionally, the C-shaped element 260 cooperates with the other elements described herein in a fashion similar to that described earlier with respect to the D-shaped element.

While the particular construction systems and elements thereof as herein shown and disclosed in detail is fully capable of obtaining the objects and providing the advantages herein before stated, it is to be understood that it is merely illustrative of the presently preferred embodiments of the invention and that no limitations are intended to the sizes or details of construction or design herein shown other than as defined in the appended claims.

What is claimed is:

1. A construction element, which comprises:

a first end portion and a second end portion, said first and second end portions having substantially equal rectangular cross sections, said end portions being parallel to one another, said rectangular cross sections of said end portions defining respective midpoints, said midpoints defining an end portion midplane, said end portion midplane being parallel to said end portions and axially bisecting said end portions;

a central web portion having a rectangular cross section, said cross section of said web portion having a width about equal to that of each of said first and second end portions, said web portion further defining a web portion midplane which axially bisects said web portion, said web midplane being parallel to and spaced apart a predetermined distance from said end portion midplane;

a first transition section having a parallelogram-shaped, non-rectangular cross section, said cross section having a width about equal to the width of said first end portion for connecting said first end portion to said web portion; and a second transition section having a parallelogram-shaped non-rectangular cross section, said cross section having a width about equal to the width of said second end portion for connecting said second end portion to said web portion, said first and second transition portions each forming an angle of about 45° with said web portion midplane to offset said first and second end portions from said central web plane by said predetermined distance.

2. A construction element as recited in claim wherein said cross section of said web portion has a span substantially equal to the combined said widths of said first and second end portions.

3. A construction element as recited in claim 2, wherein said span of web portion is about twice the width of said web portion.

4. A construction element as recited in claim 3, wherein said first and second transition portions each have a first and a second flat transition surface, said first transition surface forming an angle of about 45° with said web portion midplane, and said second transition surface forming an angle of about 45° with said web portion midplane.

5. A construction element as recited in claim 4, wherein said first end portion includes a first outer edge surface, and said second end portion includes a second outer edge surface opposite and parallel to said first outer edge surface, and wherein the distance between said first and second outer edge surfaces is about 3.7 times said width of said web portion.

6. A construction element as recited in claim 5, wherein said predetermined distance that said end portion midplane is spaced apart from said web portion midplane is equal to about one-half (0.5) of said width of said web portion.

7. A construction element as recited in claim 6, wherein said element is made of wood.

8. A construction element which comprises:

a parallelepiped-shaped web portion having a rectangular cross section and first and second opposite, parallel sides;

first and second parallelepiped-shaped transition portions, each said transition portion having a non-rectangular cross section and each said transition portion having first and second parallel opposite edges, said first edges of said transition portions being respectively integrally formed with said first and second edges of said web portion; and first and second parallelepiped-shaped end portions, each of said end portions having a rectangular cross section and each of said end portions having first and second opposite parallel edges, said first edges of said end portions being respectively integrally formed with said second edges of said transition portions to establish a C-shaped cross section of said element.

* * * * *